US011479937B2

(12) United States Patent
Guindi

(10) Patent No.: US 11,479,937 B2
(45) Date of Patent: Oct. 25, 2022

(54) COMBINATION PLATE AND LATERAL STABILIZERS FOR USE WITH A POST AND POST SPIKE

(71) Applicant: Sami Guindi, Saint-Lambert (CA)

(72) Inventor: Sami Guindi, Saint-Lambert (CA)

( * ) Notice: Subject to any disclaimer, the term of this patent is extended or adjusted under 35 U.S.C. 154(b) by 0 days.

(21) Appl. No.: 17/062,554

(22) Filed: Oct. 3, 2020

(65) Prior Publication Data

US 2021/0102353 A1 Apr. 8, 2021

(30) Foreign Application Priority Data

Oct. 4, 2019 (GB) ..... 1914400

(51) Int. Cl.

| | |
|---|---|
| ***E02D 5/80*** | (2006.01) |
| ***E04H 12/22*** | (2006.01) |
| ***E04H 17/22*** | (2006.01) |
| ***E04H 12/20*** | (2006.01) |

(52) U.S. Cl.

CPC ..... *E02D 5/80* (2013.01); *E04H 12/2269* (2013.01); *E04H 12/20* (2013.01); *E04H 17/22* (2013.01)

(58) Field of Classification Search

CPC ... E02D 5/80; E02D 2600/20; E02D 2600/30; E02D 2200/115; E04H 12/2269; E04H 12/2292; E04H 12/223; E04H 17/22; E04H 12/22; E04H 12/2261; E04H 12/2284; E04H 12/2215; A63G 31/12; G09F 2007/1813; G09F 2007/1817; G09F 7/20

See application file for complete search history.

(56) References Cited

U.S. PATENT DOCUMENTS 632,966 A * 9/1899 Mullenix ..... E02D 5/80 52/158
1,764,207 A * 6/1930 Johnson ..... E04H 12/2215 52/151
2,800,850 A * 7/1957 McKann ..... F23L 17/02 454/366
3,117,760 A * 1/1964 Dresbach ..... A63B 1/00 248/188.5
3,698,144 A 10/1972 Stratton
3,704,004 A * 11/1972 Carter, Jr. ..... E04H 17/063 256/1
3,724,145 A * 4/1973 Daniel ..... E02D 5/801 52/157
3,785,107 A * 1/1974 Garretson ..... E04H 17/268 52/514

(Continued)

*Primary Examiner* — Brian D Mattei
*Assistant Examiner* — Omar F Hijaz
(74) *Attorney, Agent, or Firm* — Chris Pilling

(57) ABSTRACT

A combination of a plate and lateral stabilizers is provided. The present invention's main use is in conjunction with a regular fence post spike to support a fence installation so as to add strength against high wind or when the fence is installed in soggy alluvial soils, but the same invention can also be used on sign posts, telephone posts and the likes. This is accomplished by the shape of the device transferring lateral wind forces into vertical downward force to the ground. The lateral stabilizer are so efficient that it can even support a surface mounted post that has no ground embedded spike. The present invention could even allow for a post to simply rest on the ground without any in ground spike, all depending upon the intended use of the post.

3 Claims, 9 Drawing Sheets

(56) References Cited

U.S. PATENT DOCUMENTS

| | | | | |
|---|---|---|---|---|
| 4,803,812 | A * | 2/1989 | Alexander, Sr. | E02D 5/801 52/157 |
| 5,722,205 | A * | 3/1998 | Gannaway | E04H 12/2215 52/153 |
| 6,527,255 | B2 * | 3/2003 | O'Berry | E04H 17/063 256/1 |
| 7,380,561 | B2 * | 6/2008 | Nobert | E04H 12/2215 135/118 |
| 8,523,134 | B2 * | 9/2013 | Walker | E04H 17/22 248/508 |
| 8,646,735 | B2 * | 2/2014 | Bradley | F16B 9/02 248/121 |
| 9,262,948 | B2 * | 2/2016 | Pounders | G09F 13/02 |

* cited by examiner

FIG. 1A
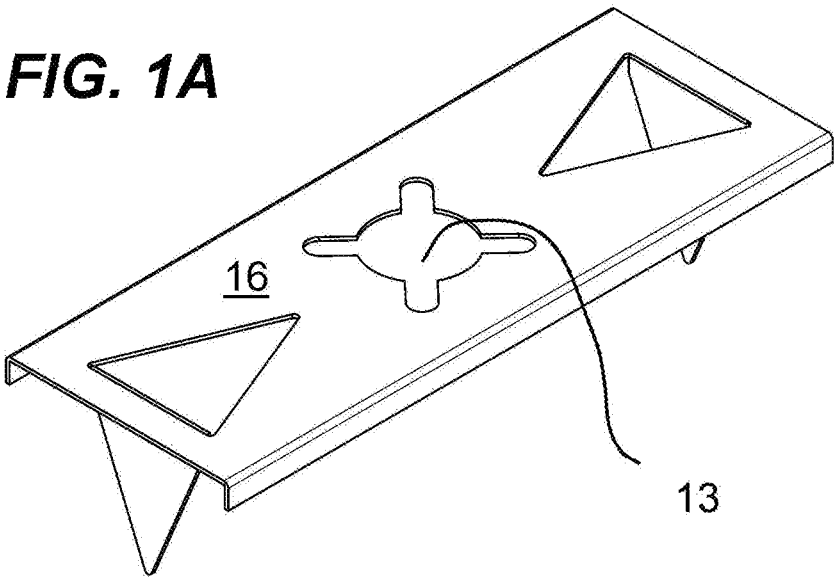
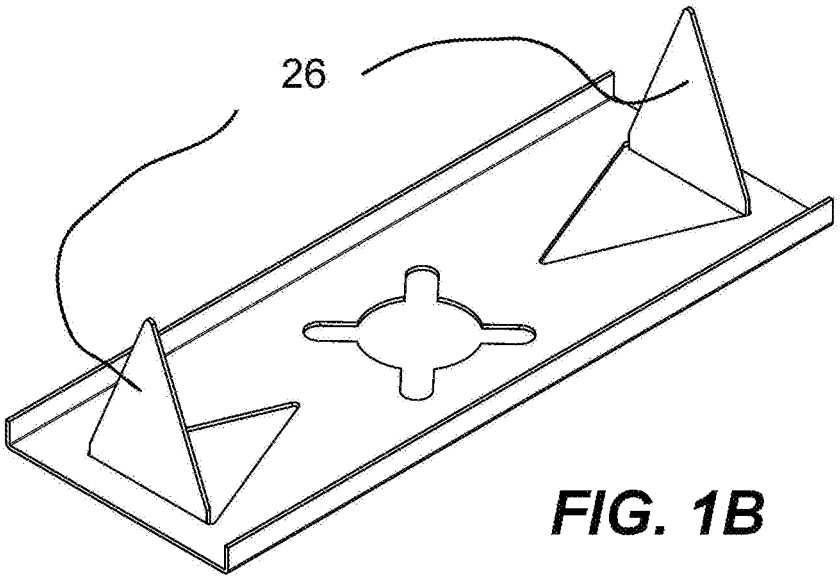
FIG. 1B

COMBINATION PLATE AND LATERAL STABILIZERS FOR USE WITH A POST AND POST SPIKE

CROSS-REFERENCE TO RELATED APPLICATIONS

The present application claims priority to application number GB1914400.5, filed on Oct. 4, 2019, the disclosure of which is hereby incorporated in its entirety at least by reference.

BACKGROUND OF THE INVENTION

1. Field of the Invention

The present invention relates generally to pillars and posts but more particularly to a combination of a plate and lateral stabilizers for use to stabilize posts and a post spike having lateral stabilizers.

2. Description of Related Art

Posts, such as fence posts or telephone posts, for example, have two main components: posts that are planted in the ground or use an attached spike planted in the ground. There are many ways in which a post can be embedded into the ground. Sometimes a steel or wooden post is planted into a soft concrete base, which is in a hole dug in the ground. Sometimes the post itself is hammered down deep into the ground so as to stabilize. A more recent innovation, aimed more particularly at square wooden posts, is the use of a steel spike mechanically fastened to the base of a post. The spike is driven into the ground so as to provide a strong securing of the post. Because of various soil conditions such as repeated freezing and thawing, accumulation of water, drought, etc, the soil around the spike can become loose over time and the post is no longer well supported. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide for a combination of a plate and lateral stabilizers for use with a post and a post spike having at least one lateral stabilizer.

In order to do so, there is provided a spike member having a plate at its upper part. The plate extends perpendicularly from the spike and has at least one but preferably a pair of diagonal struts extending upwardly therefrom to connect with a sleeve section into which the post is inserted or directly connected to the post.

In one aspect of the invention a combination plate and lateral stabilizers for use with a post and a post spike is provided, the invention comprising a rigid plate having a central opening, wherein the central opening is configured to receive the post spike, wherein the post spike is configured to be inserted into a ground soil; the post spike including a sleeve configured to receive the post; and, a pair of blades positioned or configured to be positioned at each end of the rigid plate, wherein the pair of blades are configured to be positioned into the ground soil securing the rigid plate in position.

In another aspect of the invention a combination plate and lateral stabilizers for use with a post and a post spike is provided, the invention comprising a rigid plate having a central opening, wherein the central opening is configured to receive the post spike, wherein the post spike is configured to be inserted into a ground soil; the post spike including a sleeve configured to receive the post; a pair of blades positioned or configured to be positioned at each end of the rigid plate, wherein the pair of blades are configured to be positioned into the ground soil securing the rigid plate in position; and, a pair of diagonal struts, each strut having an upper end and a lower end, the upper end attached to a lower portion of the post, the lower end attached to one end of the rigid plate, wherein the combination of the rigid plate and the pair of diagonal struts providing lateral stability to the post.

In one embodiment, each strut comprises clips and the rigid plate comprises holes configured to receive the clips. In one embodiment, the opening comprises a number of rays corresponding to the post spike. In one embodiment, the rigid plate is rectangular. In another embodiment, the rigid plate is comprised of two U-shaped portions configured to surround the post spike, wherein the post spike is an existing post spike already positioned in the ground soil.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIG. 1A is a top isometric view of a plate according to an embodiment of the present invention.

FIG. 1B is a bottom isometric view of the plate according to an embodiment of the present invention.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide combination plate and lateral stabilizers for use with a post and a post spike.

Figure 2A:
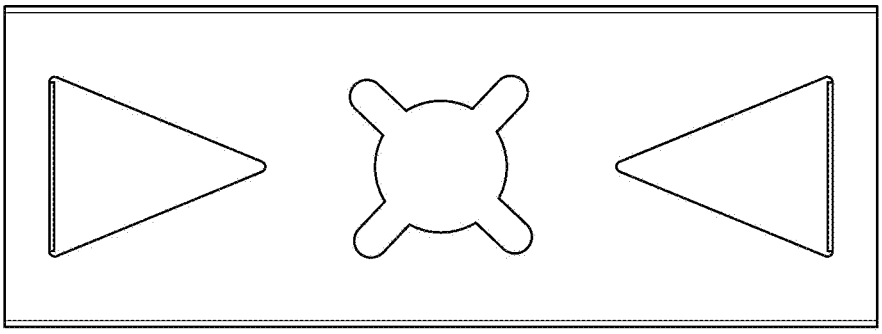
FIG. 2A is a top view of the plate according to an embodiment of the present invention.
Figure 2B:
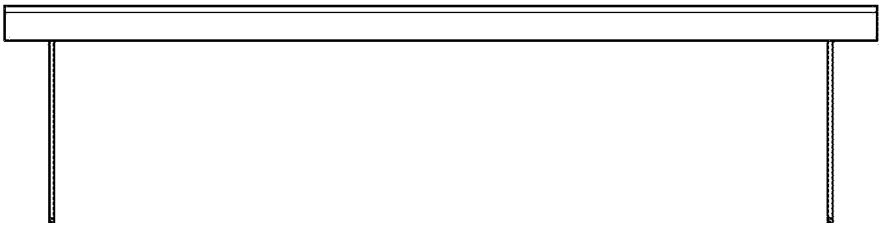
FIG. 2B is a side view of the plate according to an embodiment of the present invention.
Figure 3:
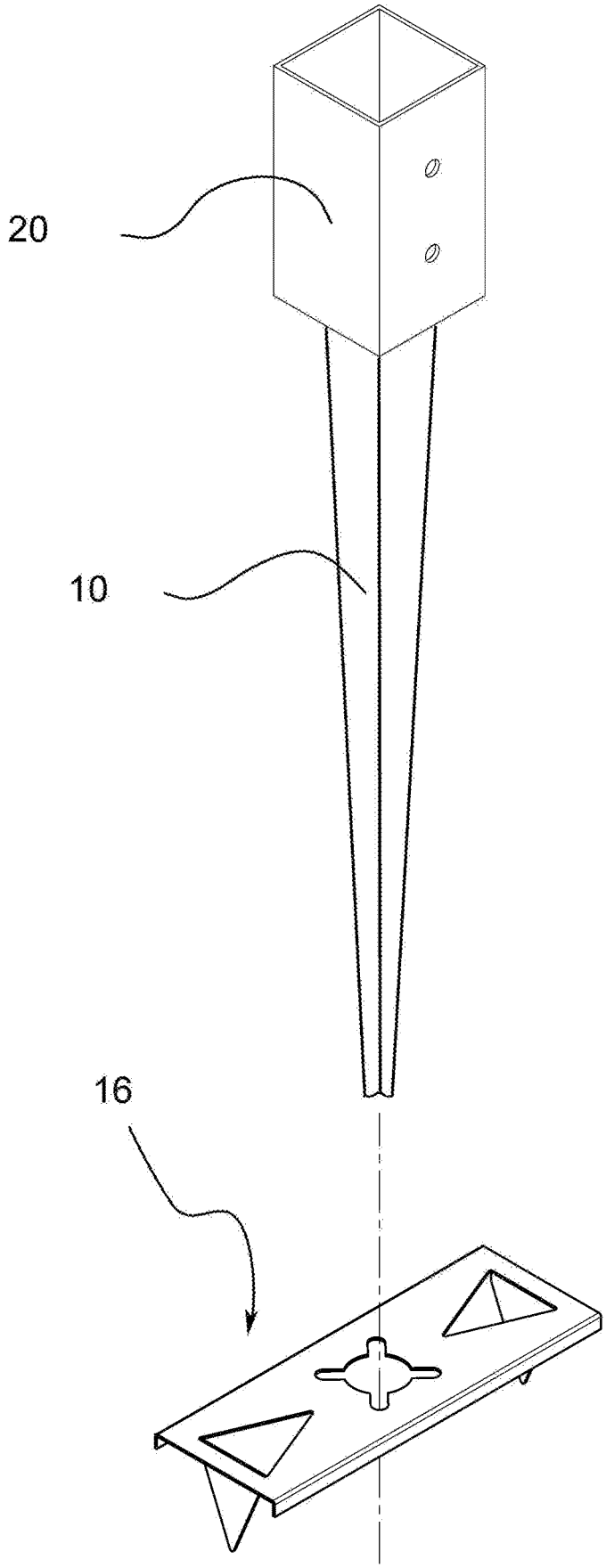
FIG. 3 is an isometric view showing a post spike above the plate according to an embodiment of the present invention.

FIGS. 1-2 show various views of a plate according to an embodiment of the present invention. Referring now to FIGS. 1-2, the plate 16 is illustrated. The plate 16 is a rigid rectangular member comprising spikes or blades 26 positioned at each end of the rectangular plate. In one embodiment, the plate 16 comprises an opening 13, wherein the opening is centrally positioned in the rectangular plate 16. In some embodiments, the opening 13 comprises a number of rays configured to match the configuration of a post spike 10 (FIG. 3). In the embodiment illustrated, four rays are provided, however it should be understood that any number of rays may be provided. For example, 8 or even 16 rays may be provided, wherein the number of rays allow for any configuration of post spikes 10 to be fitted through the plate 16.

Figure 4:
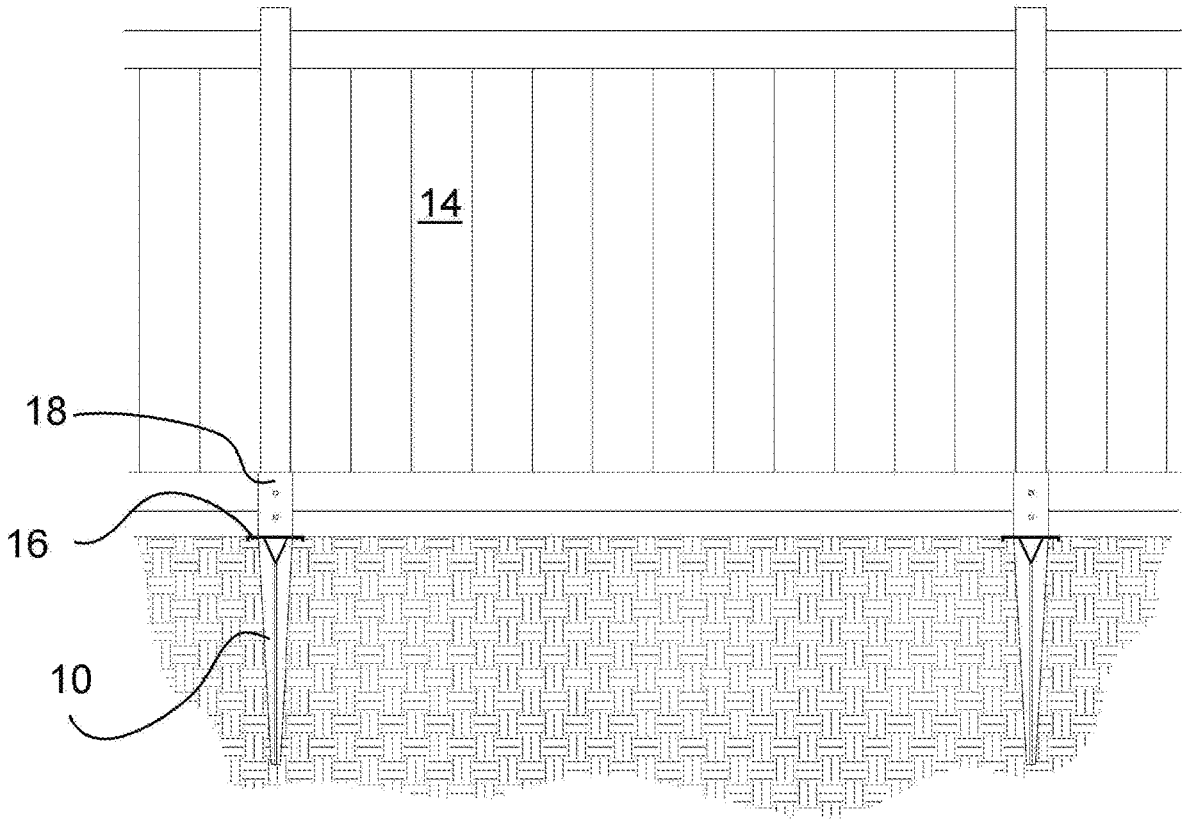
FIG. 4 is a side view of the present invention installed on a fence.

The configuration of the present invention previously described is configured to be used with a new post installation. For example referring to FIGS. 3-4, the blades 26 of plate 16 are configured to be vertically inserted into soil where the new post is configured to be installed. The rectangular plate 16 is perpendicular to the spikes and the post spike 10, wherein the post spike is positioned through the opening 13 of the plate 16. A sleeve 20 on the post spike is configured to receive a post 11, such as a post used to install a fence 14.

Figure 5A:
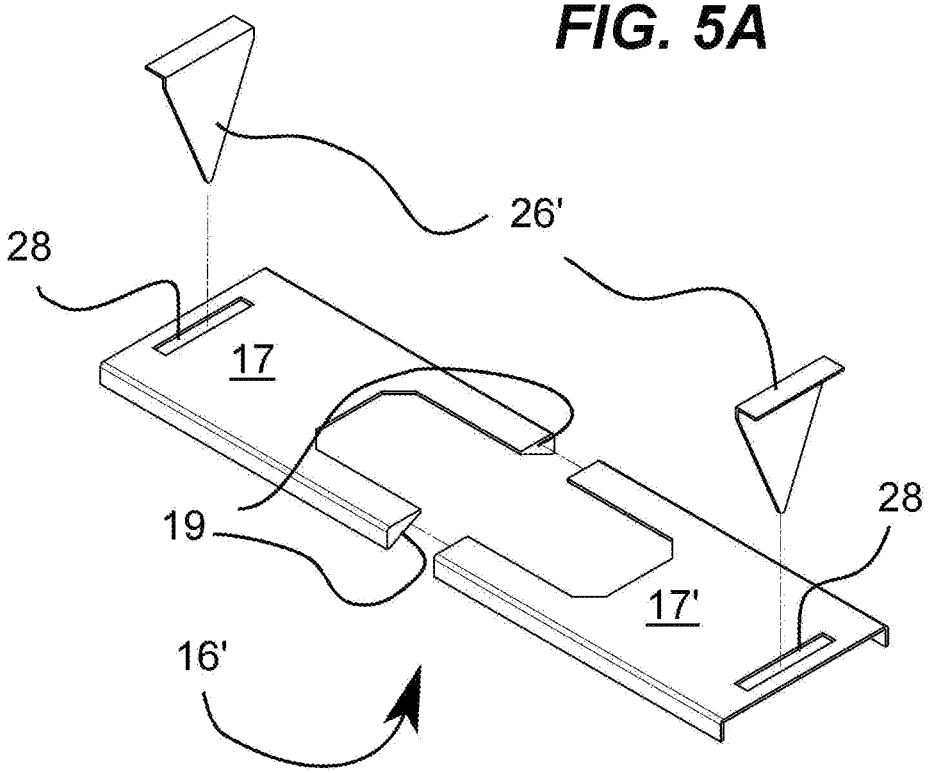
FIG. 5A is an exploded isometric view of an alternate embodiment of the plate for use on an existing fence according to an embodiment of the present invention.
Figure 5B:
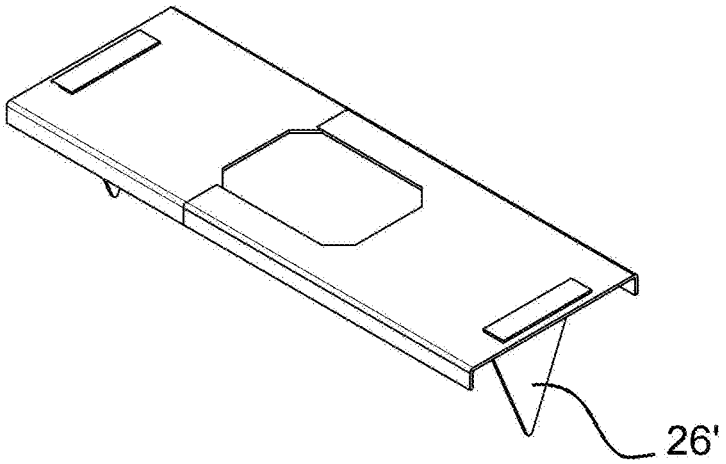
FIG. 5B is an isometric view of the alternate embodiment of the plate for use on an existing fence according to an embodiment of the present invention.

FIGS. 5A-B are isometric views of an alternate embodiment of the plate for use on an existing fence according to an embodiment of the present invention. Referring now to FIGS. 5A-B, an alternate plate 16' is illustrated. In one embodiment, the alternate plate 16' comprises a top plate 17 and a bottom plate 17' each constructed from a U-shape, such that when connected they form an opening. Each U-shape portion of the plate (top 17 and bottom plate sections 17') is configured to surround an existing post. In this embodiment, a slot 28 is positioned on each portion of the alternate plate, wherein the slot is configured to receive blades 26'. These blades are configured to be inserted into the soil to secure the plate into the ground. The blades 26' in the current embodiment are unlike the blades 26 previously discussed, as they do not form part of the plate 16 and are separate and inserted into the soil through slots 28 made into the bottom and top plate sections 17, 17'. In one embodiment, the top plate section 17 is provided with triangular plow members 19 which are designed to work in a debris rich environment by assisting in the removal of debris while sliding together to complete a tight fit surrounding an existing post spike.

Figure 6A:
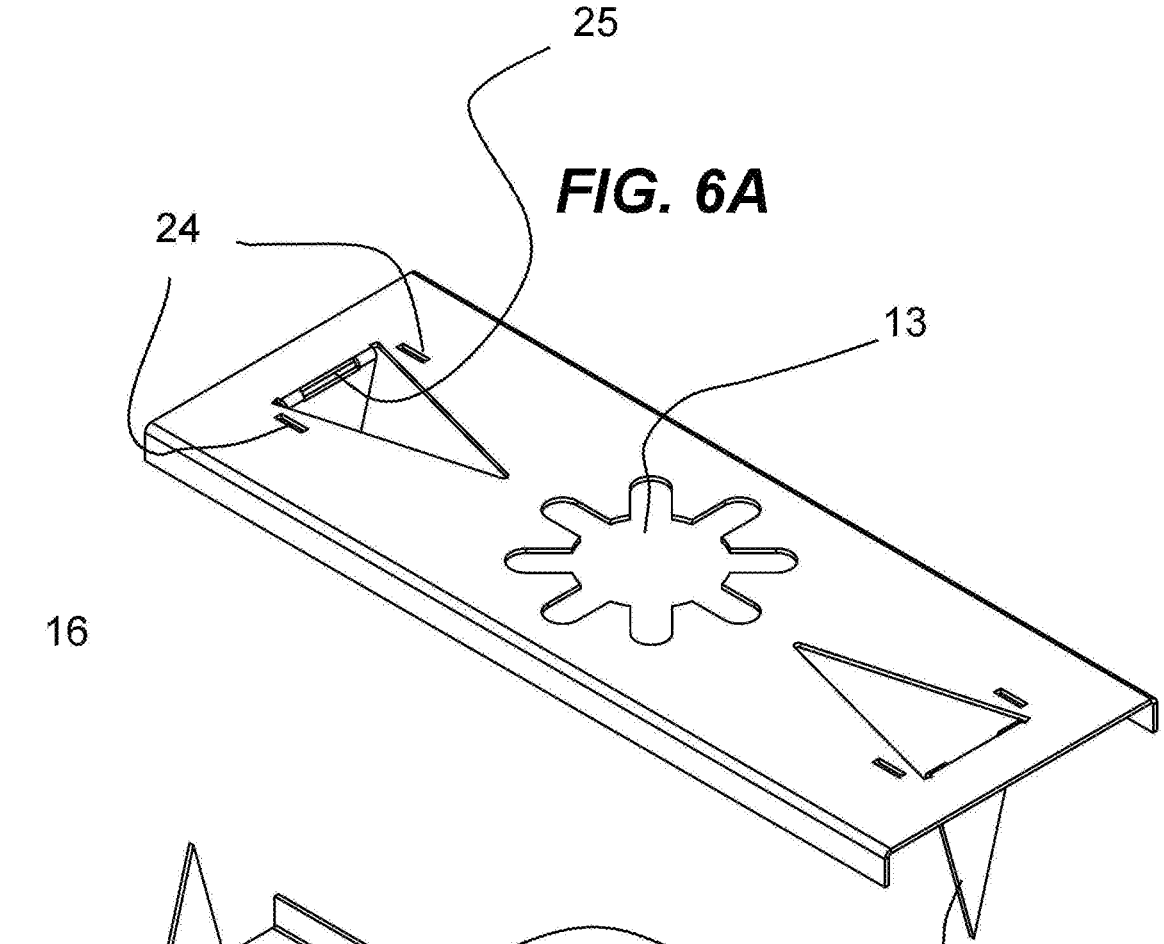
FIG. 6A is a top isometric view of a second alternative embodiment of a plate according to an embodiment of the present invention.
Figure 6B:
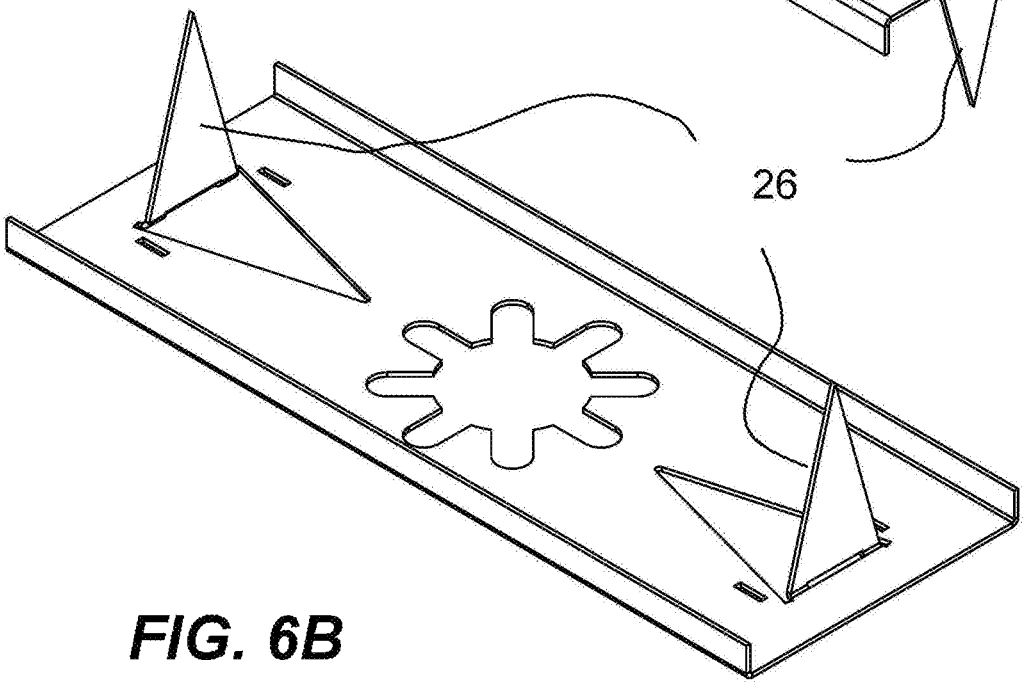
FIG. 6B is a bottom isometric view of the second alternative embodiment of a plate according to an embodiment of the present invention.
Figure 7:
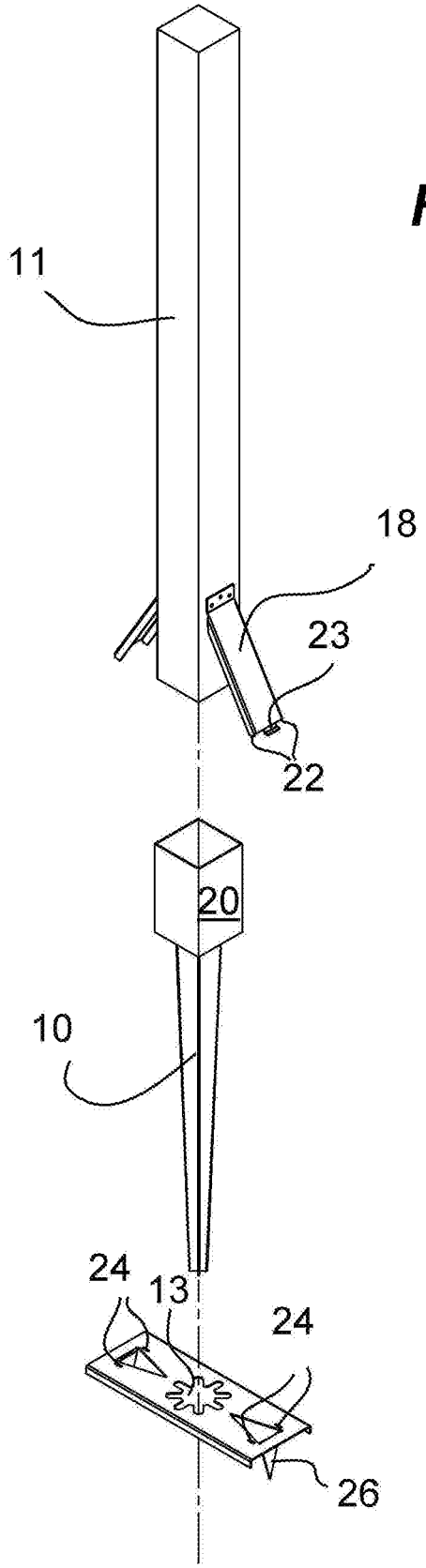
FIG. 7 is an exploded view of a post, spike and a combination plate and lateral stabilizers along with struts according to an embodiment of the present invention.
Figure 8:
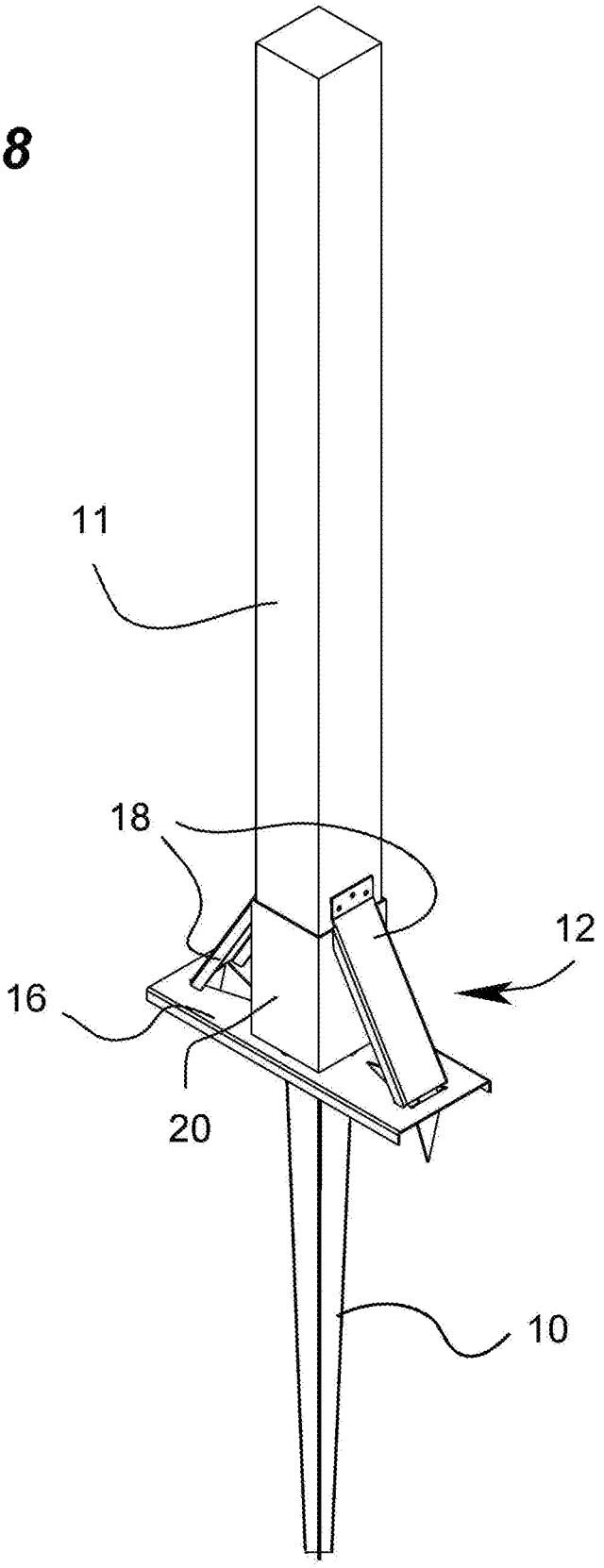
FIG. 8 is an isometric showing the components of FIG. 7 assembled according to an embodiment of the present invention.
Figure 9:
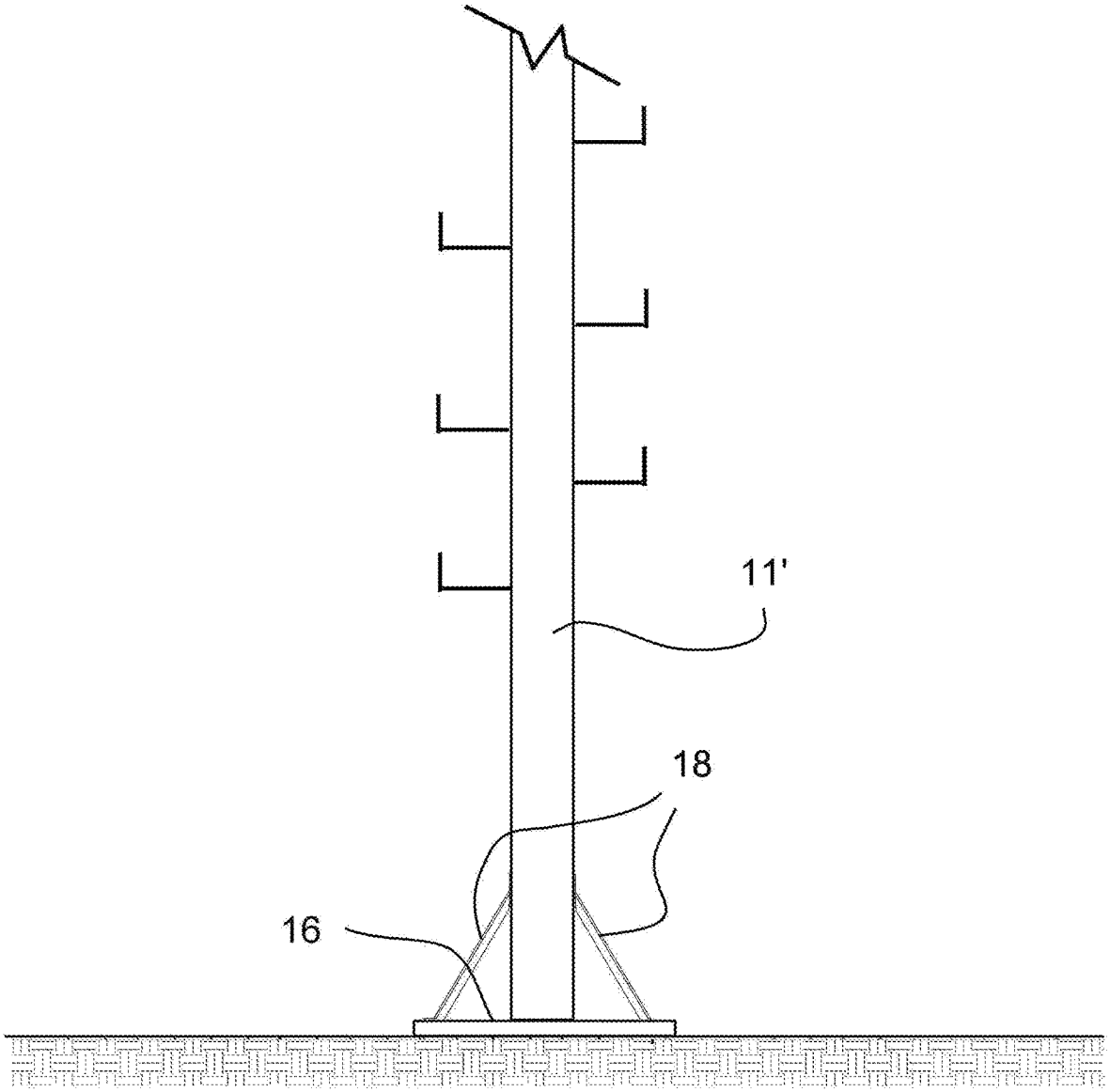
FIG. 9 is a side view showing the present invention installed on a telephone post (pole).

FIGS. 6A-B are isometric views of a second alternative embodiment of a plate according to an embodiment of the present invention. FIGS. 7-8 show exploded and assembled views of a post, spike and a combination plate and lateral stabilizers along with struts according to an embodiment of the present invention. FIG. 9 is a side view showing the present invention installed on a post 11'. Referring now to FIGS. 6-9, a post spike 10 for use in combination with a post 11 is illustrated. In one embodiment, the post 11 is fitted through an opening 13 of combination plate 16. In one embodiment, the combination plate 16 is part of a lateral stabilizer 12, wherein the lateral stabilizer 12 comprises a pair of diagonal struts 18 extending upwardly and configured to connect with sleeve 20 of the post spike 10 or alternatively directly to the post 11, and extending integrally from the post spike 10.

Advantageously, the pair of diagonal struts 18 improves the lateral rigidity and strength by being directly connected from the edges of the combination plate 16 for added leverage. It should be understood that although a pair of diagonal struts 18 are illustrated, one diagonal strut may be provided depending on the stability of the soil of which the post spike 10 is positioned when installed.

In one embodiment, during installation, the post 11 is inserted into the sleeve 20 and each of the pair of diagonal struts 18 are mechanically fastened onto the post 11. In one embodiment, on the upper part of each diagonal strut 18 includes pins 22 and a clip 23 on the lower part of each diagonal strut 18, wherein the clips 23 are used for insertion into holes 24 provided in the plate 16. In one embodiment, the clip is clipped to the underside of the plate 16 through a gap 25 created by a slot within the radius of a bend that also creates a blade 26 forming part of the plate 16, i.e. the blades 26 are folds made in the plate 16. The blades 26 are vertically implanted into the soil so as to provide extra stability, especially when it comes to redirecting the force applied onto them by the struts 18.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A combination plate and lateral stabilizers for use with a post and a post spike comprising:

a rigid plate comprised of a top U-shaped plate and a bottom U-shaped plate, wherein the top U-shaped plate is configured to slide over the bottom U-shaped plate defining an adjustable central opening, wherein the adjustable central opening is configured to receive and surround the post spike, wherein the post spike is configured to be inserted into a ground soil;

the post spike including a sleeve configured to receive the post;

a pair of blades positioned or configured to be positioned at each end of the rigid plate, wherein the pair of blades are configured to be positioned into the ground soil securing the rigid plate in position; and, a pair of diagonal struts, each strut having an upper end and a lower end, the upper end attached to a lower portion of the post, the lower end attached to a hole at one end of the rigid plate via a clip, wherein the combination of the rigid plate and the pair of diagonal struts providing lateral stability to the post.

2. The combination plate and lateral stabilizers of claim 1, wherein the top U-shaped plate is provided with triangular plow members configured to work in a debris rich environment by assisting in the removal of debris while the top U-shaped plate and the bottom U-shaped plate slide together to form the adjustable central opening.

3. The combination plate and lateral stabilizers of claim 1, wherein the post spike is an existing post spike.

* * * * *